US008614409B2

(12) United States Patent
Stuehr et al.

(10) Patent No.: US 8,614,409 B2
(45) Date of Patent: Dec. 24, 2013

(54) INDUCTION HEATING DEVICE WITH ELECTROMAGNETIC DIVERTER

(75) Inventors: William I. Stuehr, North Royalton, OH (US); John E. Gadus, Brunswick, OH (US)

(73) Assignee: Induction Tooling, Inc., North Royalton, OH (US)

( * ) Notice: Subject to any disclaimer, the term of this patent is extended or adjusted under 35 U.S.C. 154(b) by 1078 days.

(21) Appl. No.: 11/163,700

(22) Filed: Oct. 27, 2005

(65) Prior Publication Data

US 2006/0124632 A1 Jun. 15, 2006

Related U.S. Application Data

(60) Provisional application No. 60/622,384, filed on Oct. 27, 2004.

(51) Int. Cl.
*H05B 6/38* (2006.01)
*H05B 6/14* (2006.01)

(52) U.S. Cl.
USPC ..... 219/644; 219/676

(58) Field of Classification Search
USPC ..... 219/644, 632, 635, 639, 640, 672, 676, 219/656, 645, 646, 670, 671; 266/125, 129; 148/573, 572, 576, 569, 500
See application file for complete search history.

(56) References Cited

U.S. PATENT DOCUMENTS

| | | | | | |
|---|---|---|---|---|---|
| 3,720,803 | A | * | 3/1973 | Lewis | 219/653 |
| 4,363,946 | A | | 12/1982 | Busemann | |
| 4,438,310 | A | | 3/1984 | Cachat | |
| 4,538,041 | A | * | 8/1985 | Budzinski | 219/676 |
| 4,628,167 | A | | 12/1986 | West | |
| 4,855,551 | A | * | 8/1989 | Mucha et al. | 219/640 |
| 5,451,749 | A | | 9/1995 | Griebel et al. | |
| 6,576,877 | B2 | | 6/2003 | Dabelstein et al. | |
| 6,765,181 | B1 | | 7/2004 | Chatterjee et al. | |

* cited by examiner

*Primary Examiner* — Quang Van
(74) *Attorney, Agent, or Firm* — Rankin, Hill & Clark LLP

(57) ABSTRACT

An induction heating element includes a primary conductive portion and a secondary conductive portion. The primary conductive portion is connected to a power source, and conducts electric current from the power source to generate a magnetic field that inductively heats a portion of the workpiece. The secondary conductive portion is electrically insulated from the primary portion, and receives an induced electric current from the primary portion to affect the magnetic field generated by the primary portion.

5 Claims, 10 Drawing Sheets

INDUCTION HEATING DEVICE WITH ELECTROMAGNETIC DIVERTER

FIELD OF THE INVENTION

The present invention relates to an inductor assembly, and in particular, to an inductor assembly that is used for contour induction heat-treatment of workpieces.

BACKGROUND OF THE INVENTION

Induction heat-treatment is a widely used process for the surface hardening of steel workpieces. The workpieces are heated by producing a high-frequency alternating magnetic field, so that selected surface regions of the workpiece are heated to a temperature within or above the transformation range, followed by immediate quenching. The core of the workpiece remains unaffected by this treatment and its physical properties are those of the bar from which it was machined, while the treated regions of the workpiece are metallurgically hardened.

One such workpiece is a bearing sleeve having an internal bore with bearing support surfaces or races disposed along the interior surface. Selected portions of the interior surface can be heat treated and metallurgically hardened by magnetic induction, in which an inductor body is positioned within the bore and quickly energized to magnetically induce an electric current in selected regions of the workpiece and heat those portions to a high temperature before quickly quenching them. The region of heat-treating of the interior surface of the workpiece is defined by the contour of the magnetic flux pattern produced by the coil of the inductor body.

The inductor body is connected to an AC power source adapted for this purpose, so that AC current flowing through the inductor will create a magnetic field that penetrates the workpiece and induces an eddy current in the workpiece. The heating of the workpiece by this eddy current and the subsequent quench is used to metallurgically harden the workpiece, but only the region in which the current is magnetically induced is hardened in this process. The other portions of the workpiece remain unaffected. The contour of the heating pattern is accomplished by the shape of the inductor and/or the shape of the coils on the inductor body.

In the case of heating the interior bore of a workpiece that has a varying inner diameter profile, such as a bearing sleeve, the induction element must have an outer diameter that is no larger than the smallest inner diameter of the workpiece bore, so that the induction element can be inserted and removed from the bore. A typical bearing sleeve for two sets of bearings has a bearing separator or straddle between the two bearing surfaces. At the straddle the interior bore has a reduced inner diameter, and the inductor body must have a maximum outer diameter no greater than this minimum inner diameter.

These limitations on the configuration of the inductor may cause the magnetic field produced by the inductor to heat portions of the workpiece that do not need to be heated. A further problem can result if these portions should not be hardened for various reasons, such as the need to perform further machining operations on these portions. For example, in the case of a bearing sleeve, it may not be possible using conventional induction elements to avoid hardening substantial portions of the straddle, and it may be desirable to perform further machining operations on the straddle, such as to drill a port through this portion of the bearing sleeve. If the straddle has been inductively hardened, it becomes more difficult to drill through the straddle.

SUMMARY OF THE INVENTION

The disadvantages of the prior art are overcome by the present invention of an induction heating element that produces a contour heating pattern in a different manner than the prior art. The induction heating element of the present invention shapes the induction field without relying entirely upon the configuration of the element.

In accordance with the present invention, the induction heating element has a secondary induction coil that is not directly connected to the power source used to produce the field by the primary coil. This secondary coil is electrically insulated from the primary coil, so that the only current in the secondary coil is the result of induction from the primary coil. The secondary coil thus creates its own magnetic field that opposes the magnetic field produced by the primary coil. The field produced by the secondary coil thus shapes the field produced by the primary coil, resulting in contoured induction pattern.

Because the inductor head of the present invention does not rely solely upon the exterior shape or configuration of the head to contour the induction field, the present invention makes it possible to create an inductor head that can fit into places previously not possible with prior art induction elements. In the case of hardening the interior bore of a workpiece such as a bearing sleeve, it is possible with the present invention to effectively harden the bearing surfaces without substantially hardening the bearing separator that is directly adjacent to the bearing surfaces, even though the bearing separator may extend substantially into the bore and create the minimum inside diameter. Although the inductor head of the present invention must be very close to the straddle, it can substantially avoid hardening the straddle by the positioning the secondary coil which will divert the induction field away from the straddle.

The principles of the present invention may be used in other applications in which it is desirable to shape the induction pattern away from certain portions of the workpiece. Specialized patterns can be created without relying upon the shape of the inductor head. Smaller induction regions can be created, resulting in reduced power requirements and cost savings.

These and other advantages are provided by the present invention of an induction heating element for treatment of a workpiece. The induction heating element comprises a primary conductive portion and a secondary conductive portion. The primary conductive portion is connected to a power source, and conducts electric current from the power source to generate a magnetic field that inductively heats a portion of the workpiece. The secondary conductive portion is electrically insulated from the primary portion, and receives an induced electric current from the primary portion to affect the magnetic field generated by the primary portion.

DETAILED DESCRIPTION OF THE PREFERRED EMBODIMENTS

Figure 1:
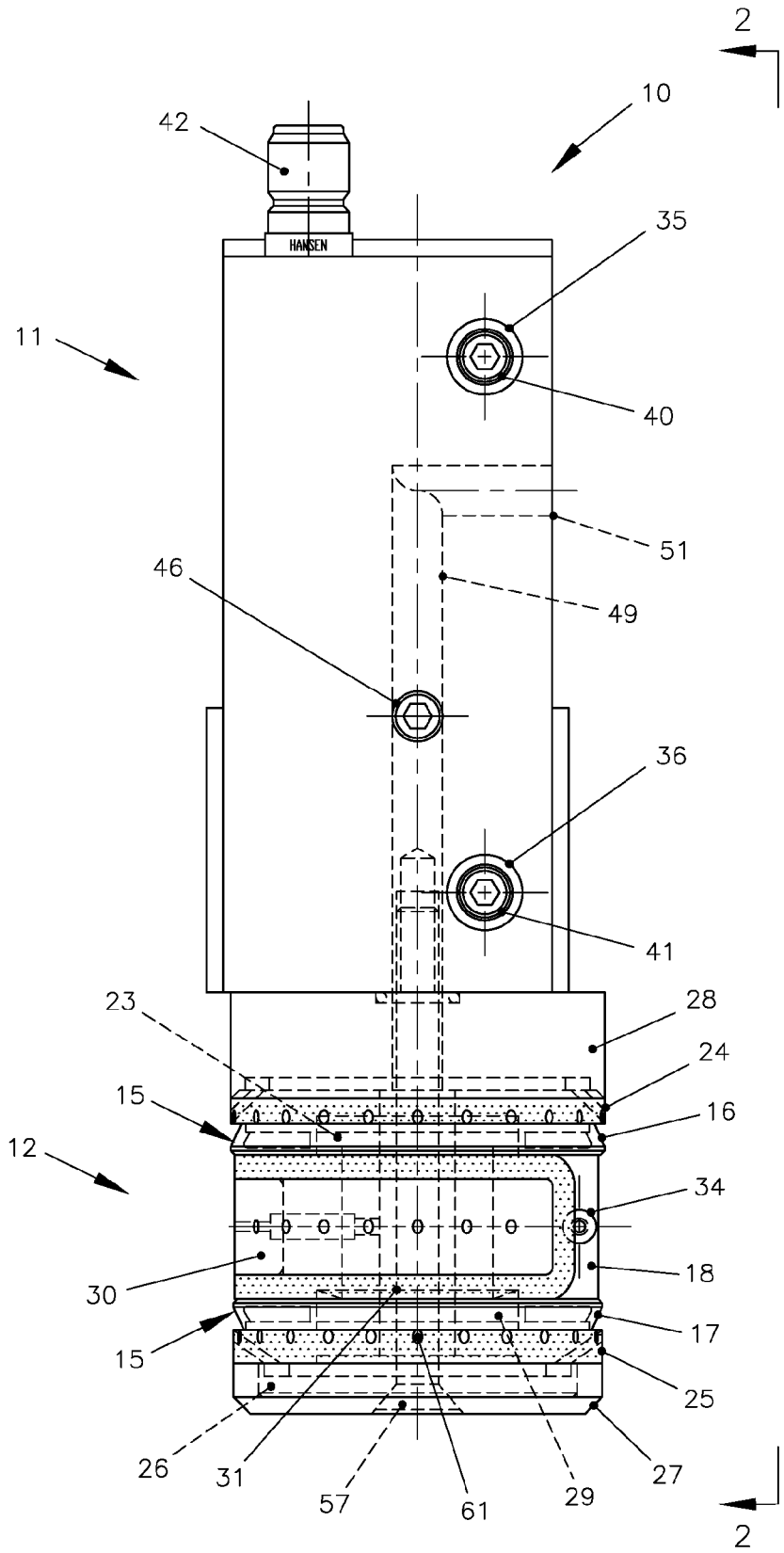
FIG. 1 is a side elevational view of an inductor assembly according to the present invention.

Referring more particularly to the drawings, and initially to FIG. 1, there is shown an inductor assembly 10 according to the present invention. The assembly 10 comprises a cylindrical inductor body or head 12 and a cylindrical inductor contact body 11 attached at one end of the inductor head for mounting the inductor head in an induction heat treating apparatus.

Figure 2:
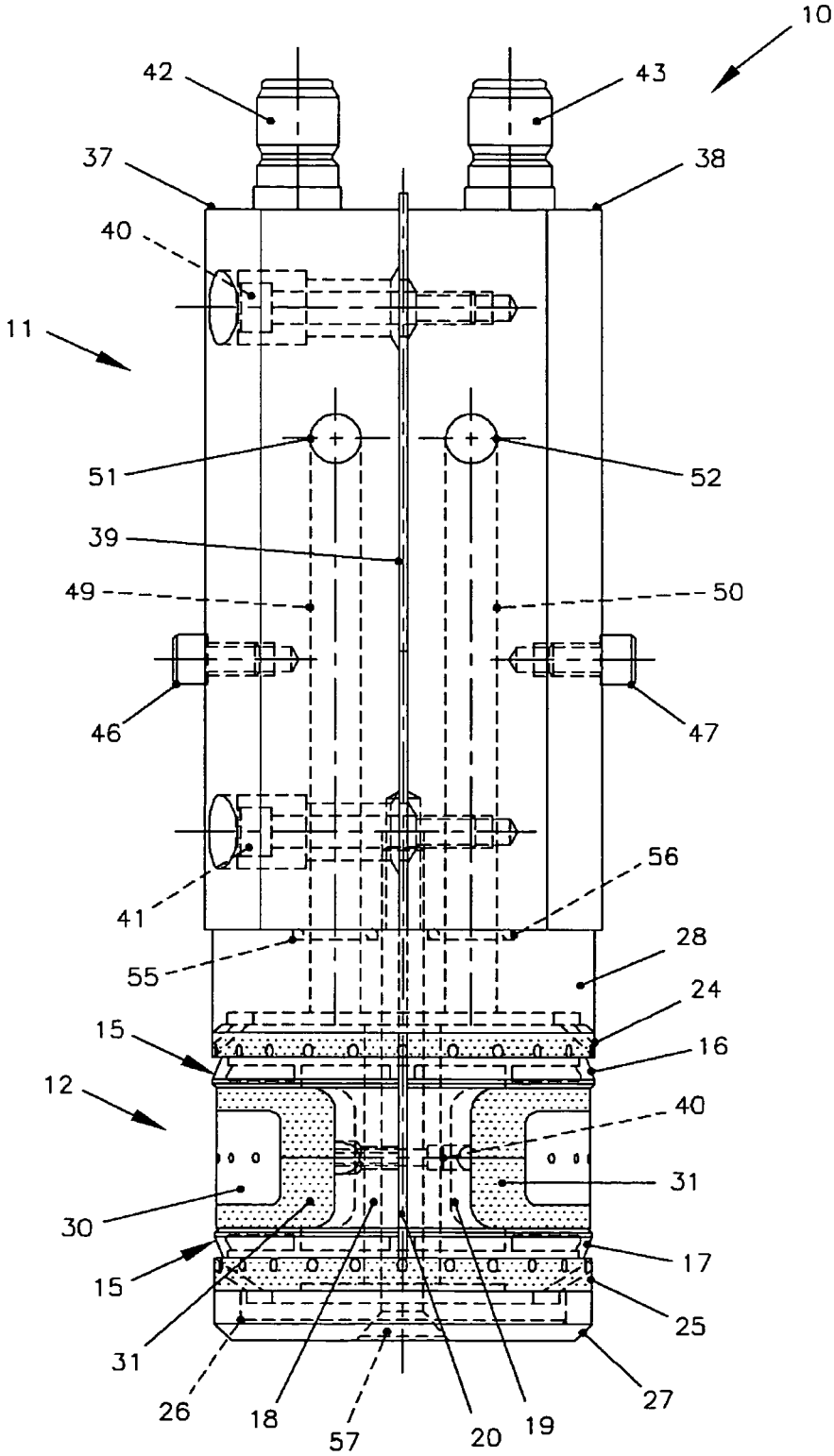
FIG. 2 is another side elevational view taken along line 2-2 of FIG. 1.
Figure 3:
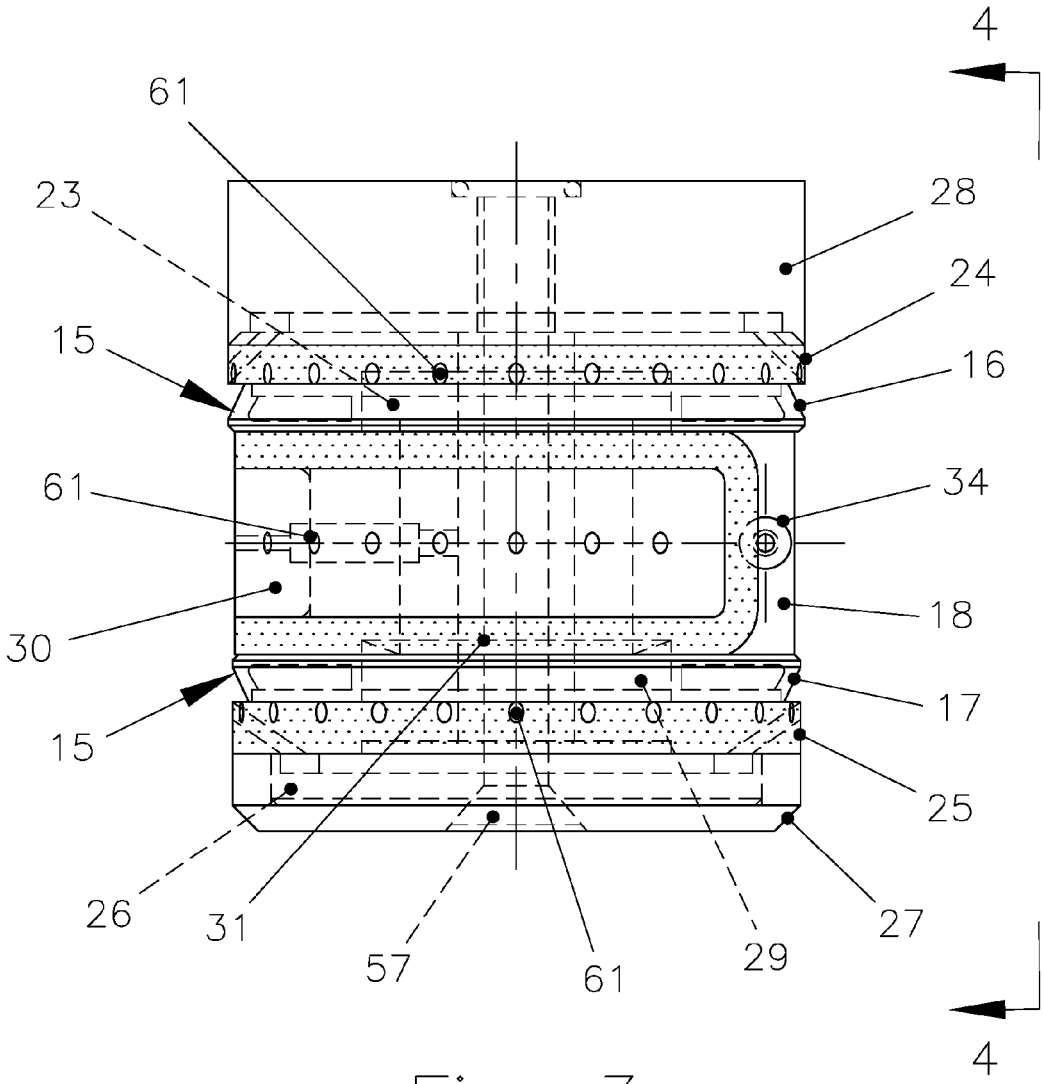
FIG. 3 is a detailed side elevational view of a portion of the inductor assembly of FIG. 1 comprising the inductor head.
Figure 4:
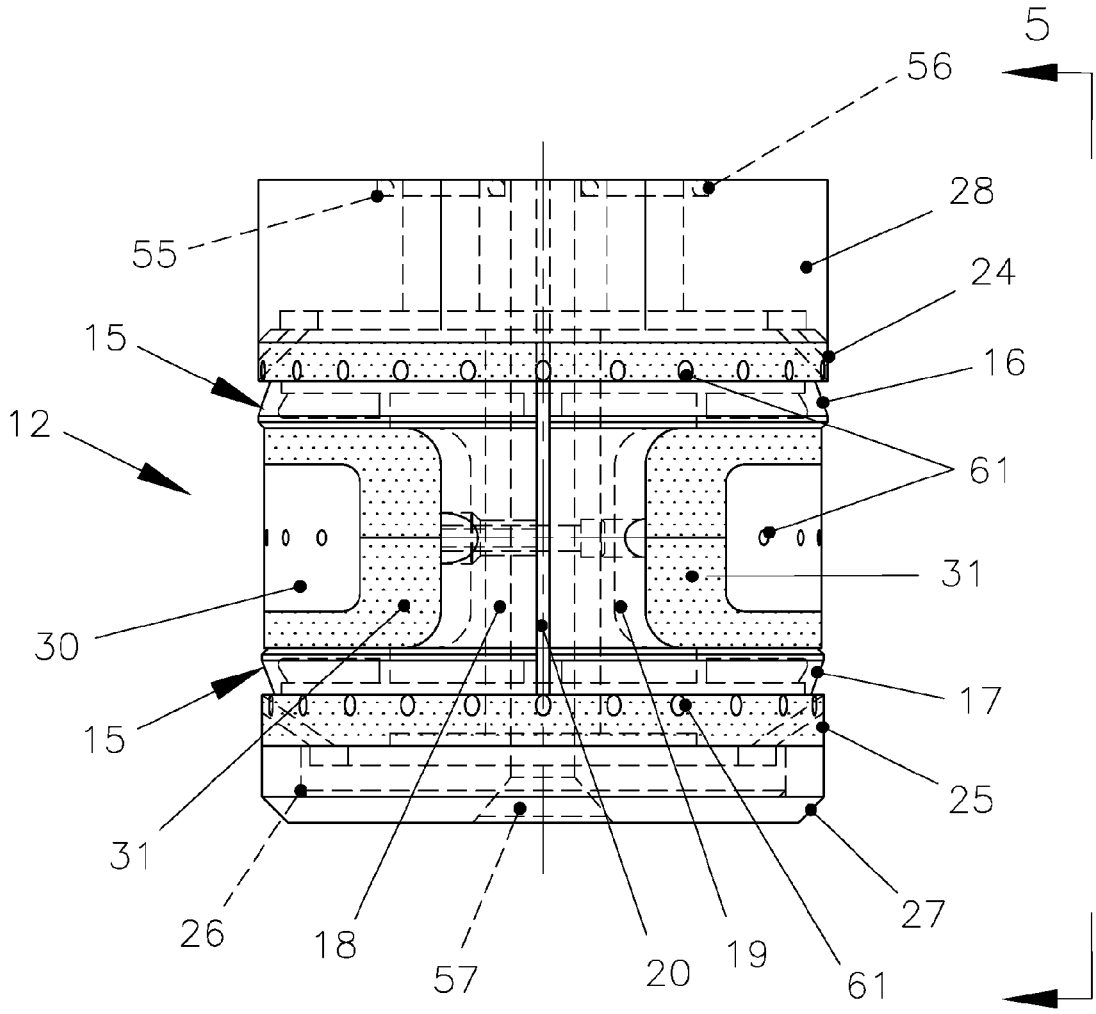
FIG. 4 is another side elevational view taken along line 4-4 of FIG. 3.

The inductor head 12 of FIGS. 1 and 2 is shown in more detail in FIGS. 3 and 4. The inductor head 12 comprises a primary conductive portion in the form of an inductor loop or coil 15 made of a highly electrically conductive material such as copper, with portions connected together so as to highly electrically conductive. The inductor coil 15 includes two loops 16 and 17, a pair of jumper legs 18 and 19. Each of the two inductor loops 16 and 17 is axially spaced apart from the other, and each extends almost completely circumferentially around the inductor head. A small gap is provided on one side of the inductor head so that the inductor loops 16 and 17 do not extend entirely around the inductor head. The two inductor loops 16 and 17 are electrically connected together at each end adjacent to this gap by the jumper legs 18 and 19. The jumper legs 18 and 19 extend parallel to each other and axially with respect to the inductor head to connect each of the two inductor loops 16 and 17 together. The gap that separates each of the inductor loops 16 and 17 continues axially between the jumper legs 18 and 19 to provide an insulator 20 between the jumper legs. The jumper leg insulator 20 is preferably made of a suitable electrically insulating material such as polytetrafluoroethylene (PTFE) resin. The insulator 20 extends radially completely through the insulator head, and the top inductor loop 16 has a second gap on the side of the inductor head opposite the jumper legs 18 and 19. First and second head jumpers extend upwardly from the ends of the top inductor loop 16 formed by this second gap containing the insulator 20. The two head jumpers are each contacted to one of the first and second contact bodies 37 and 38 contained in the inductor contact body 11. A fastener, extending through a jumper insulator bushing 34, extends through the insulator head 12 to attach the jumper leg insulator 20.

The inductor coil 15 thus provides a continuous electrical path for electrical potential traveling between the first contact body 37 and the second contact body 38. The path travels from the contact body 37 through a portion of the top loop 16, though the first jumper leg 18, through the bottom loop 17, through the second jumper leg 19, through the other portion of the top loop 16, and finally to the second contact body 38. The electrical energy traveling in this path creates an induction field or flux field around the inductor head 12 that essentially has two radially outwardly extending areas of energy, one portion adjacent to each of the inductor loops 16 and 17.

A pair of intensifier rings 24 and 25 is provided, one adjacent to each of the inductor loops 16 and 17, positioned axially away from the other inductor loop. Top intensifier core 23 is also provided inside the top loop 16, and an interlocking intensifier core 29 is provided inside the bottom loop 17. The intensifier cores 23 and 29 and the intensifier rings 24 and 25 are made of a known material for this purpose, such as Ferrotron. Ferrotron is a non-conductive magnetic material consisting of pure iron powder uniformly dispersed in an insulating plastic binder such as PTFE. The small iron particles form very small paths which, coupled with the insulating properties of the binder, result in high permeability low hysteresis losses and temperature resistance up to 300° C. This combination of properties makes Ferrotron an ideal intensifying material for induction hardening, particularly of difficultly shaped parts, such as gear wheels, bearing sleeves and dovetailed slides. The use of intensifier elements, such as the rings 24 and 25 adjacent to rings of the inductor coil, is well known and need not be described in further detail. The intensifier cores 23 and 29 and the intensifier rings 24 and 25 may be made together in the form of a single integral body.

An insulating bottom cap 27 is provided on the end of the inductor head next to the intensifier ring. An insulating top cap 28 is also provided on the other end of the inductor head 12 between the intensifier ring 24 and the contact body 11. The bottom cap 27 and the top cap 28 are each made of a suitable non-conductive material such as Delrin.

In accordance with the present invention, a secondary conductive portion formed by an inductive coil or loop is also provided by means of a diverter ring 30 extending circumferentially around the inductor head 12 between the inductor loops 16 and 17. The middle diverter ring 30 is electrically insulated from both loops 16 and 17 of the primary inductor coil by means of an intensifier ring 31 made of the same material as the intensifier rings 24 and 25. Since the diverter ring 30 is insulated from the electrical path through the primary inductor coil 15, it is not directly energized when the inductor head is connected to the power supply. However, since the diverter ring 30 is highly conductive, a current is induced in the diverter ring 30 when the primary coil 15 is energized, so that the diverter ring forms a secondary coil. The current that is induced in this secondary coil travels around the outer edges of the ring 30 in a direction directly opposite to the direction of current travel in the primary coil 15. The induced current in the secondary coil reshapes the induction field or flux field produced by the primary coil, pushing the field away from the axial position of the middle diverter ring 30 and more towards the axial ends of the inductor head 12.

Another diverter ring 26 is also provided at the bottom end of the assembly, separated from the bottom loop 17 by the bottom intensifier ring 25. The bottom diverter ring 26, like the middle diverter ring 30, is made from a conductive material, and is insulated from the externally energized inductor coil 15 by the bottom intensifier ring 25. The bottom diverter ring 26 is also indirectly energized when a current is inducted in the ring by the current in the bottom loop 17 of the inductor coil 15. The bottom diverter ring 26 further shapes the flux field produced by the primary coil in the area at the bottom of the inductor assembly.

The inductor contact body 11 provides a means for mounting the inductor head 12 in an induction heating apparatus. The inductor contact body 11 comprises the two large contact bodies 37 and 38 each made of copper or other highly conductive material, separated by an insulator 39 made of PTFE.

The contact insulator 39 extends the top of the jumper leg insulator 20 in the same general plane. The two contact bodies 37 and 38 and the intermediate contact insulator 39 are attached together by fasteners 40 and 41. Insulator bushings 35 and 36 are provided around each of the fasteners 40 and 41, respectively, to insulate the fasteners from the contact bodies 37 and 38. Each of the contact bodies 37 and 38 provide a high current path for electrical energy flowing to and from the inductor head 12. Each of the contact bodies has a cooling inlet quick disconnect 42 and 43 extending from the top end. Locator stop bolts 46 and 47 extend from each side of the inductor contact body, generally in the middle of each the contact bodies 37 and 38, respectively.

One of two quench passages 49 and 50 extends through each of the contact bodies 37 and 38, respectively, for the flow of quenching fluid from the induction heating apparatus to the workpiece. Each quench passage 49 and 50 extends generally axially through the one of the contact bodies, and includes a radial portion that communicates with the exterior of the inductor head through an inlet port 51 and 52.

The quench passages 49 and 50 communicate with corresponding passages in the inductor head 12. O-ring seals 55 and 56 are provided between the contact body passages 49 and 50 and the inductor head passages. The passages in the inductor head 12 are connected to a plurality of holes 61 provided on the exterior of the inductor head. The holes 61 are provided in each of the intensifier rings 24 and 25 and in the middle diverter ring 30. The holes 61 allow for the quenching liquid, such as water, to be sprayed onto the workpiece at the end of the induction hardening process.

A suitable fastener 57, such as a screw made of nylon, is used to secure the elements of the inductor head 12 together and the mount the inductor head onto the inductor contact body 11.

Figure 5:
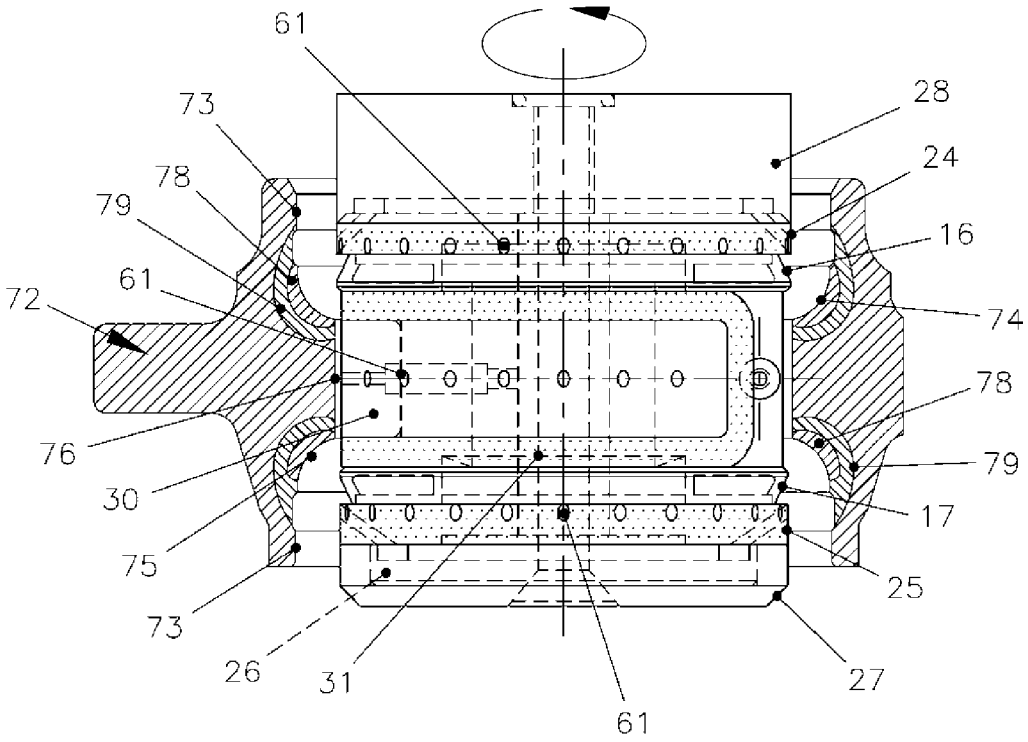
FIG. 5 is a side sectional view, similar to FIG. 3, showing the same portion of the inductor assembly in relation to a workpiece being induction heat-treated.
Figure 6:
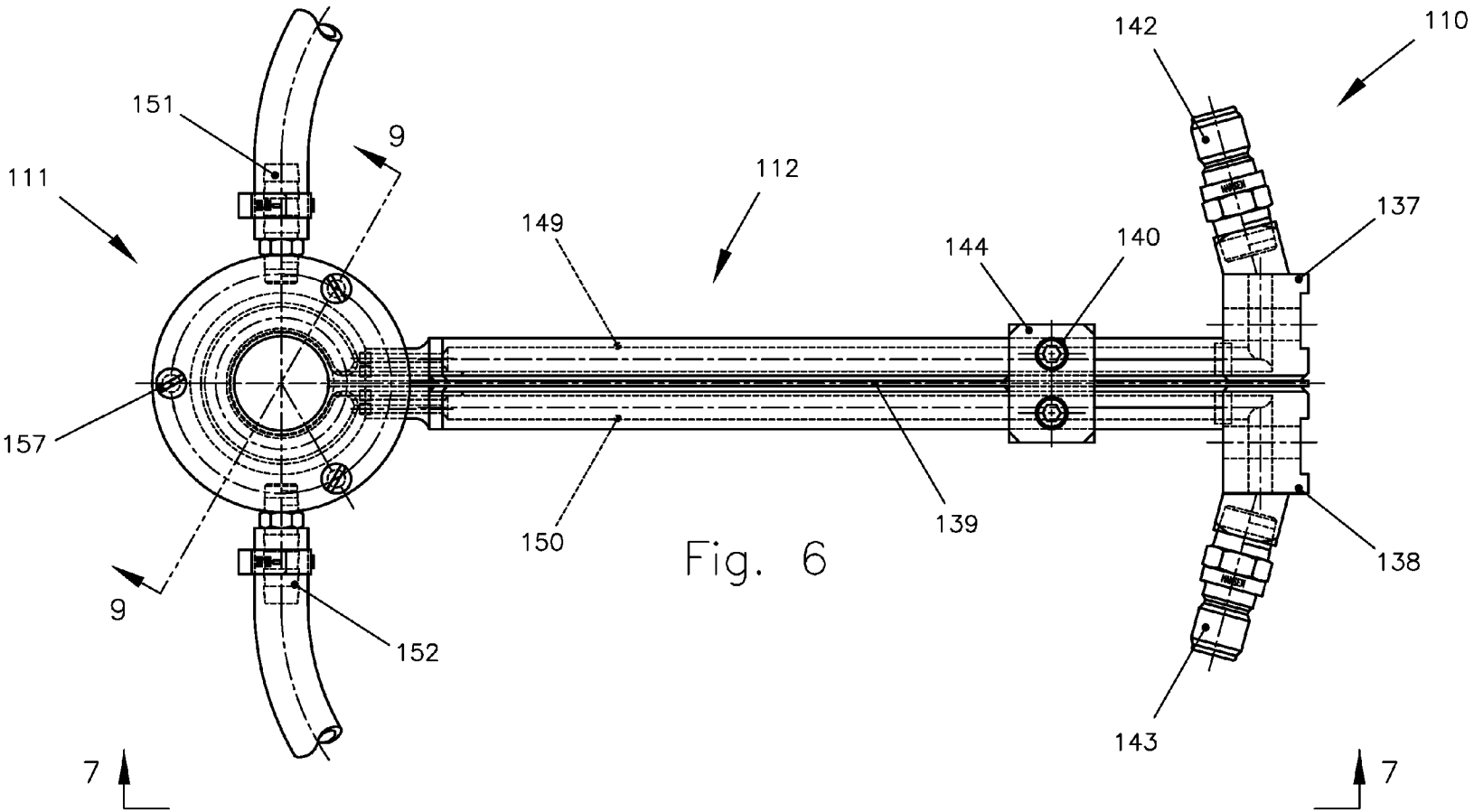
FIG. 6 is a side elevational view of another embodiment of the inductor assembly of the present invention.
Figure 7:
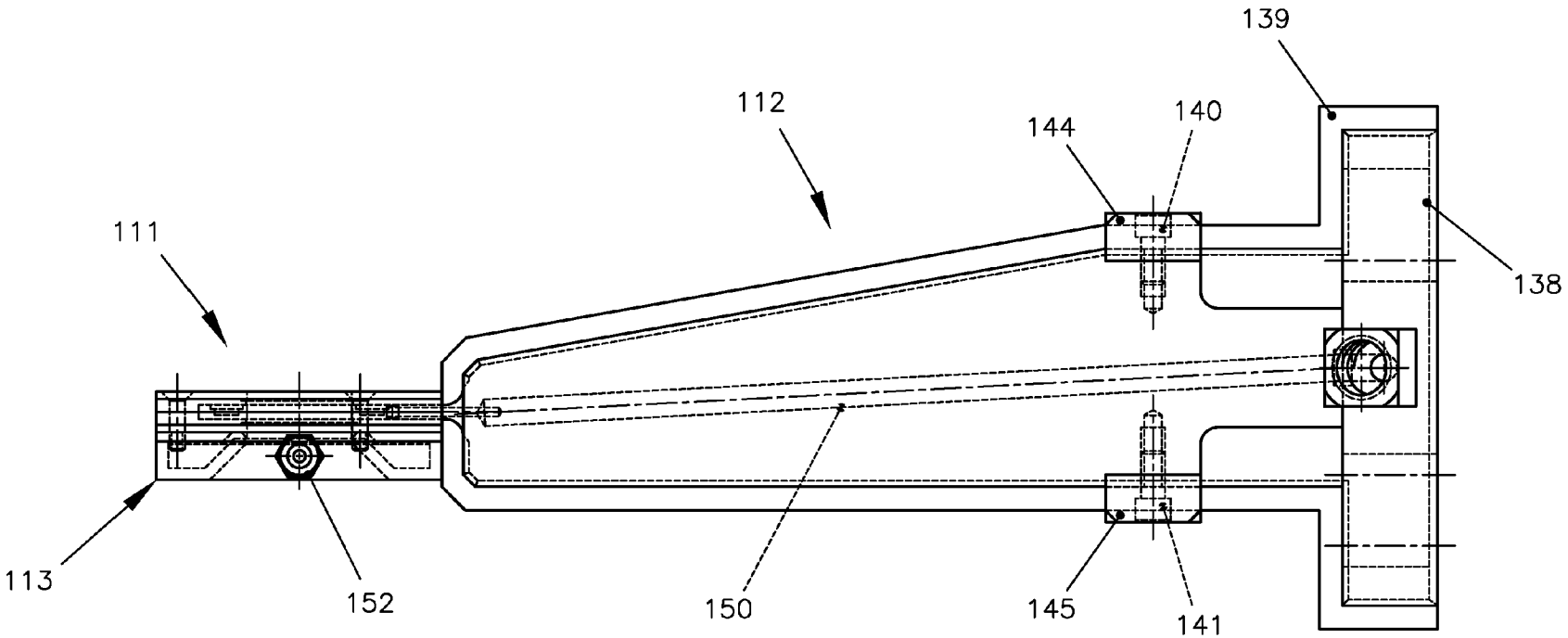
FIG. 7 is another side elevational view of the second embodiment taken along line 7-7 of FIG. 6.

The relationship of the inductor head with respect to a workpiece can be seen with reference to FIG. 5. There is shown a workpiece 72 in the form of a bearing sleeve having an interior bore 73. The interior bore 73 includes a pair of bearing support races 74 and 75 with a straddle 76 separating the two bearing races surfaces. Because the straddle 76 has a smaller inner diameter than the rest of the interior bore 73, the inductor head 12 must be made with a maximum outer diameter small enough to allow it to be moved through the straddle. This means that the inductor head 12 cannot be positioned any closer to the bearing races than is shown in FIG. 5. This would ordinarily make it difficult to provide a contoured heating pattern in which the straddle 76 is not heated to a substantial depth. In other words, an ordinary inductor head would necessarily provide a heating pattern that extends relatively deeply into the straddle due to the close proximity between the straddle and the inductor head.

In accordance with the present invention, however, the presence of the secondary coil formed by the middle diverter ring 30 creates a countering magnetic flux that shapes the heating pattern produced by the two loops of the primarily coil. The countering flux influence produced by the middle diverter ring tends to repel the flux field away from the location of the straddle. As a result the two loops of the primary coil produce heating patterns that are generally defined by the limits of the minimum heat pattern 78 and the maximum heat pattern 79 shown in FIG. 5. The resulting heating pattern, which ends somewhere between these minimum and maximum limits, does not extend substantially into the straddle. This allows the straddle to avoid substantial heat treatment, so that the straddle can be further processed as required. For example, if it is desired to machine an opening through the straddle for placement of a sensor or probe, the opening can be drilled through the straddle without difficulty, since this portion of the workpiece has not been substantially heat-treated.

In operation, the inductor assembly is mounted in apparatus for heat-treating a workpiece, such as the bearing sleeve shown in FIG. 5. The heating treating apparatus provides a fixture for holding the workpiece and provides for the high-speed rotation of the workpiece. The inductor assembly is mounted in the apparatus so that the contact bodies 37 and 38 are connected to a suitable power supply, and the quench liquid connections are connected to a supply of quench liquid. The power supply may be a 3 to 450 kHz, up to 500 kW suitable power unit used for contour induction hardening, as is known in the art. When the workpiece is inserted into the apparatus, the induction heat treating process can be initiated in which the workpiece is rotated at a high speed, such as 100 to 200 rpm, and the power supply is activated to supply power to the induction coil.

Another embodiment of the present invention is shown in FIGS. 6-10. There is shown an inductor assembly 110, which has an annular shape instead of cylindrical shape of the inductor assembly 10 of FIGS. 1-5. The inductor assembly 110 can be used to heat-treat a rod-shaped workpiece, such as a pump shaft or transmission shaft. The inductor assembly 110 comprises an inductor body or head 111 and inductor contact leads 112 by which the inductor head is mounted in an induction heat treating apparatus.

Figure 8:
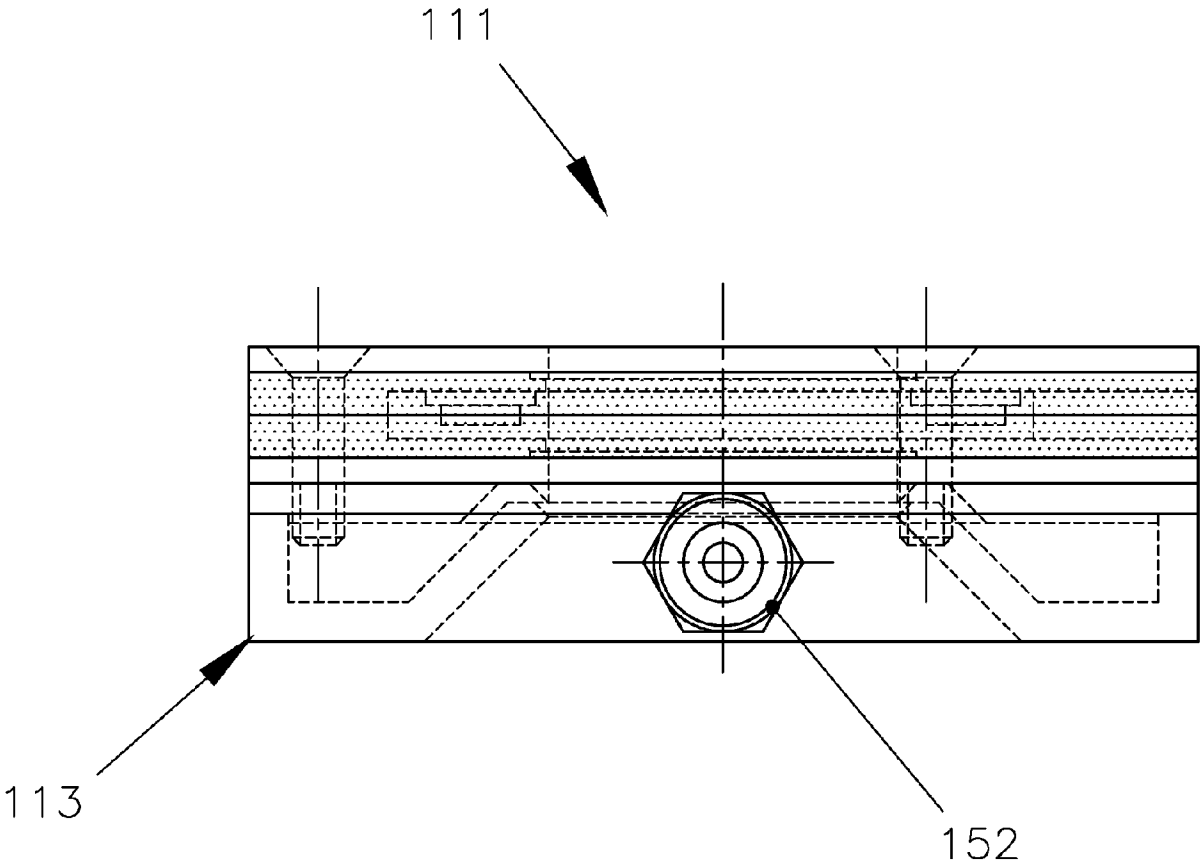
FIG. 8 is a detailed side elevational view of a portion of the inductor assembly of FIG. 6 comprising the inductor head.
Figure 9:
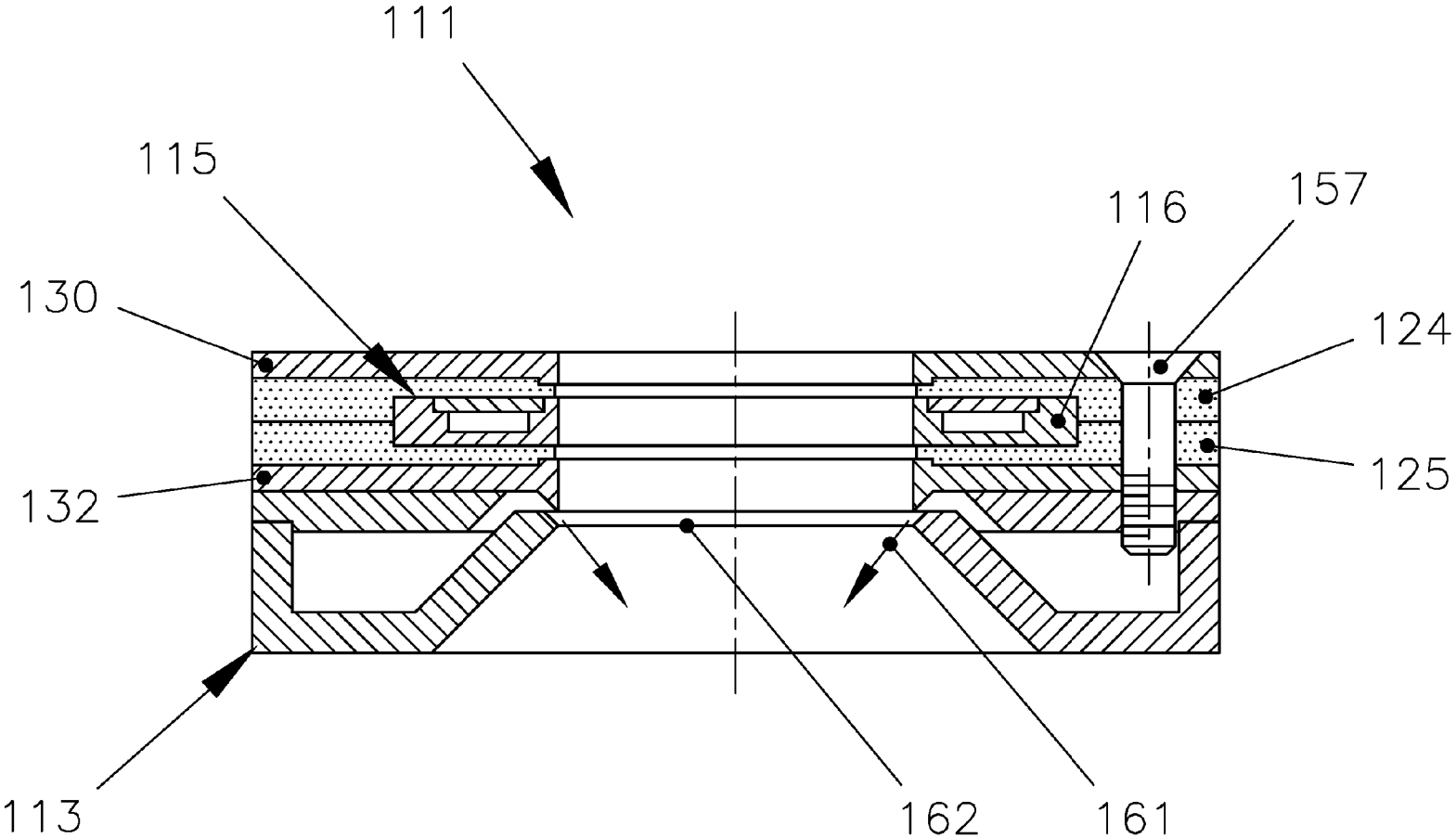
FIG. 9 is a sectional view of the portion of the inductor assembly of FIG. 8 comprising the inductor head, taken along line 9-9 of FIG. 6.

The inductor head 111, as shown particularly in FIGS. 8 and 9, has a primary conductive portion formed by an inductor coil 115 comprising an annular inductor loop 116 which is made of a conductive material such as copper and is connected to the power source, so that an induction heating field is thus produced. Annular intensifier rings 124 and 125, made of a suitable material such as Ferrotron, are provided on both sides of the inductor coil 115. The inductor head 111 also has a secondary conductive portion in the form of two annular diverter rings 130 and 132 located on either sides of the intensifier rings 124 and 125. The diverter rings 130 and 132 are both made of highly conductive material such as copper and are electrically insulated from the primary inductor coil 115 by the intensifier rings 124 and 125, respectively.

The inductor head 111 is connected inductor contact leads 112 comprising a two symmetrical contact bodies 137 and 138 extending axially from one side of the inductor head. An insulator 139 is located between the contact bodies 137 and 138 to insulate them from each other. A gap is formed in the inductor loop 116 on one side of the inductor head, and the insulator 139 extends into this gap so that the loop 116 is open on one side and each end of the loop formed by the gap is connected to one of the contact bodies 137 and 138. An insulator 139 is provided around the contact bodies 137 and 138. Top and bottom straps 144 and 145 hold the contact bodies 137 and 138 together and secure the insulator 139 onto the contact bodies. Each of the straps 144 and 145 are secured to the contact bodies 137 and 138 by fasteners 140 and 141.

A pair of cooling inlet quick disconnects 142 and 143 are located on the base of the contact bodies 137 and 138 for connection to a source of cooling liquid. Each of the contact bodies 137 and 138 has an interior passage 149 and 150, respectively, connected at one end to one of the quick disconnects 142 and 143, respectively, and connected at the other end an annular chamber in the inductor head 111. Quench inlet nozzles 151 and 152 are also provided on opposite sides of the inductor head 111. The quenching liquid is fed through the inlet nozzles 151 and 152, through the quench passages in the quench assembly 113 and through the annular chamber in the quench assembly 113 formed below the bottom diverter ring 132 and through the quench opening 162, where it is sprayed onto the workpiece in the direction 161 shown in FIG. 9.

The elements of the inductor head 111 are secured together by suitable fasteners, such as three nylon screws 157.

Figure 10:
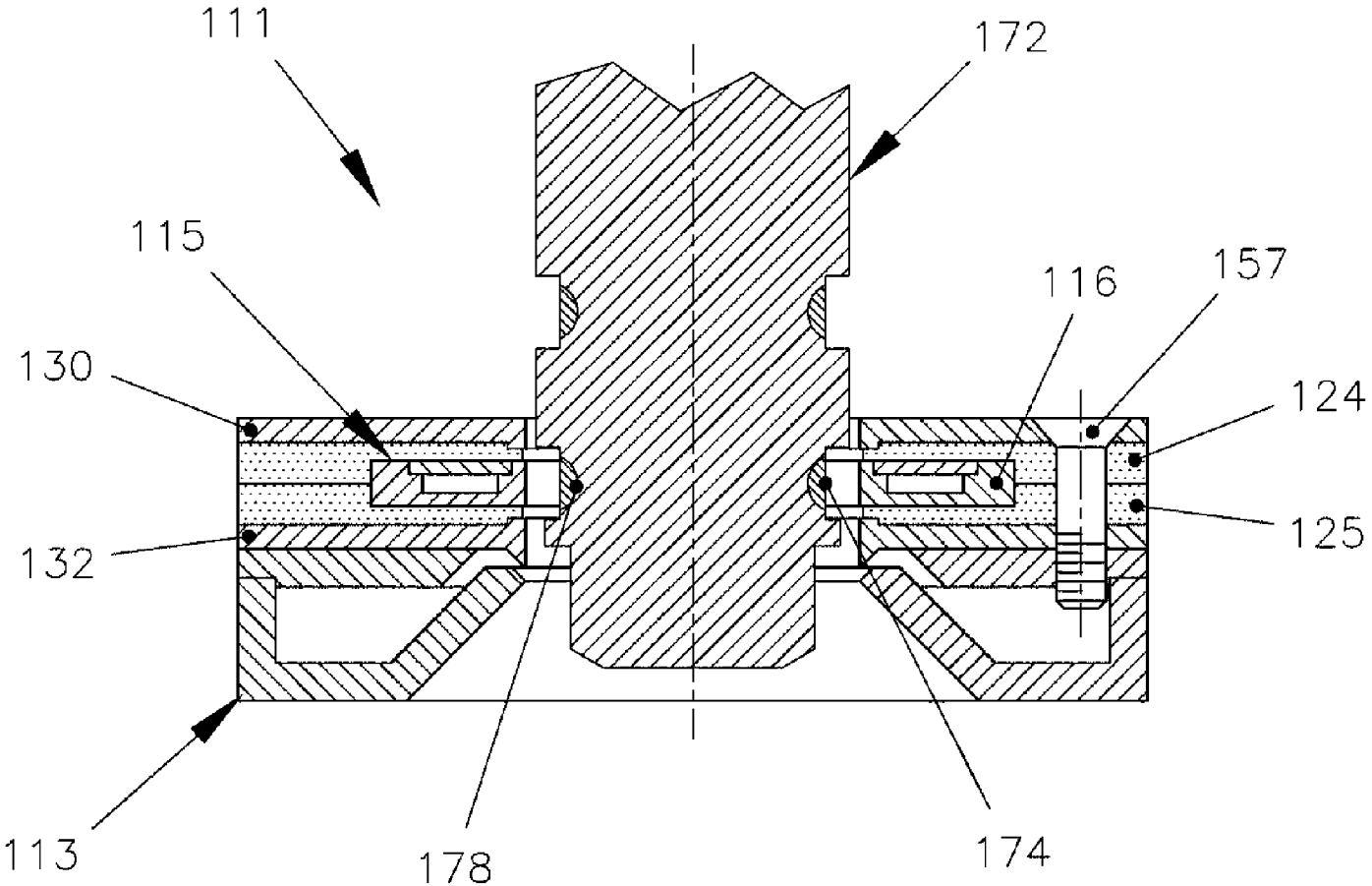
FIG. 10 is a side sectional view, similar to FIG. 9, showing the same portion of the inductor assembly in cross section in relation to a workpiece being induction heat-treated.

As shown in FIG. 10, inductor assembly 110 is used to heat-treat a workpiece 172. The workpiece 172 is in the form of a rod having a recessed bearing race 174. When connected to the power source, the primary inductor coil 115 produces an induction heating field and, at the same time, induces a current flow in both of the diverter rings 130 and 132 that is the oppose or complementary to the current flow in the primary coil. The induced current flow in the diverter rings 130 and 132 shape the resulting induction field away from the workpiece 172 to produce a contoured field in which the bearing surface 174 is induction hardened, but the regions of the workpiece 172 on either side of the bearing surface are left unaffected so that they may be machined or otherwise further processed without additional difficulty.

It should be realized that the embodiment described herein is only representative of the invention and is not intended to limit the invention to one particular embodiment as the invention includes all embodiments falling within the scope of the appended claims. Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. An inductor assembly for treatment of a workpiece, which comprises:

a body for positioning adjacent to the workpiece and movable relative to the workpiece, the body comprising a primary conductive portion for connection to a power source and capable of being positioned sufficiently close to the workpiece to effect induction heating of the workpiece when the workpiece is being treated, the primary portion conducting electric current from the power source to generate a magnetic field that inductively heats a portion of the workpiece; and a secondary conductive portion capable of being positioned adjacent to the workpiece when the workpiece is being treated, the secondary portion electrically insulated from the primary portion, the secondary portion being separate from the workpiece, the secondary portion receiving an induced electric current from the primary portion and being sufficiently close to the primary portion to shape the magnetic field generated by the primary portion that inductively heats a portion of the workpiece.

2. An inductor assembly as provided in claim 1, wherein the primary conductive portion includes two coils that are located on both sides of the secondary conductive portion.

3. An inductor assembly as provided in claim 1, wherein the primary conductive portion includes two coils for generating a magnetic field in two regions of the workpiece, and the secondary conductive portion is located between the two portions of the primary conductive portion for affecting the magnetic field between the two regions.

4. An inductor assembly as provided in claim 1, wherein the secondary conductive portion includes two portions that are located on both sides of the primary conductive portion.

5. An inductor assembly as provided in claim 1, also comprising internal passages for supplying a quenching liquid to the workpiece.

* * * * *